US005746085A

United States Patent [19]

Harada et al.

[11] Patent Number: 5,746,085

[45] Date of Patent: May 5, 1998

[54] GEAR FORMING METHOD

[75] Inventors: Koji Harada; Hisanobu Kanamaru, both of Hitachinaka, Japan

[73] Assignee: Hitachi, Ltd., Tokyo, Japan

[21] Appl. No.: 668,780

[22] Filed: Jun. 24, 1996

[30] Foreign Application Priority Data

Jun. 30, 1995 [JP] Japan ..... 7-165133

[51] Int. Cl.[6] ..... B21D 22/00

[52] U.S. Cl. ..... 72/355.6; 72/353.2; 72/355.2; 29/893.34

[58] Field of Search ..... 72/353.2, 355.2, 72/355.6, 358, 354.6, 355.4, 359, 352, 377; 29/893.34, 893.33, 893.3, 893

[56] References Cited

U.S. PATENT DOCUMENTS 3,370,450 2/1968 Scheucher ..... 72/355.2
3,832,763 9/1974 Schober ..... 29/893.34
3,910,091 10/1975 Samanta ..... 29/893.34
4,939,829 7/1990 Maki et al. ..... 29/893.34

FOREIGN PATENT DOCUMENTS 3718884 6/1987 Germany .

OTHER PUBLICATIONS

"University/industry collaboration leads to precision forge production facility", pp. 322, 324, Mettalurgia Aug. 1990.

*Primary Examiner*—Lowell A. Larson
*Assistant Examiner*—Rodney Butler
*Attorney, Agent, or Firm*—Antonelli, Terry, Stout, & Kraus, LLP

[57] ABSTRACT

A method of forming a gear through cold plastic working comprises preparing a disc-like blank, and pressing conically a central portion of the blank with a uniform pressure from upper and lower sides to cause plastic deformation in the blank thereby to form a gear along a gear-shaped die arranged around the periphery of the blank. The blank material is restrained to flow radially at peripheral end faces of the blank during the forming of the gear.

9 Claims, 6 Drawing Sheets

GEAR FORMING METHOD

BACKGROUND OF THE INVENTION

The present invention relates to a gear forming method and, particularly, to a gear forming method which is suitable for forming helical pinions for transmissions.

In general, as for forming a helical gear in particular, methods of forming gears by bulging are disclosed in JP B 6-98450 and JP A 6-31373. However, in general, the tooth portions of gears are machined by a hobbing machine.

In the above-mentioned publications, the techniques disclosed in the former technique presses only one end face of a blank using a punch to form a gear, so that it is difficult to cause the material at the other end face to flow into the die. Further, the area of the blank between the gear large diameter portion and the punch is opened from the punch to form an opening portion and the material of the blank flows into the opening portion, so that a filling of the material into the gear portion of the die becomes insufficient. As a result, both end portions of the gear are not sufficiently formed and only gears with largely sagging tooth portions are obtained.

The latter technique employs a construction in which upper and lower ring-shaped punches press both end faces of a blank. However, since the lower ring-shaped punch is fixed relative to the gear die, the material of the blank flows in the axial direction to cause a large stress in the tooth portion of the gear die and the punch crushes the end face of the gear, whereby the life of the die is remarkably shortened.

SUMMARY OF THE INVENTION

An object of the present invention is to provide a gear forming method which is able to increase the gear material filling rate and which is excellent for extension of the die life.

The above-mentioned object is achieved by enclosing peripheral portions of both ends of a blank using receiving die means to constrain plastic flow of the material of the blank in the axial direction, and by pressing concentrically on the blank with a pair of punches arranged in opposite relation to cause radial plastic flow of the material, each of the punches having a diameter equal to or less than a small diameter of a gear die arranged in a periphery thereof and a tapered portion at a tip thereof. In accordance with the present invention, preferably, an intermediate blank formed in a first forming step is inserted in a gear die and pressed by gear shaped punches, thereby to form the gear.

The blank according to the present invention is pressed concentrically with a pair of punches arranged in opposite relation, each of the punches having a diameter equal to or less than a small diameter of the gear die, so that an extreme bear barrel-shaped deformation can be prevented, and the material flows plastically in the gear die in the radial direction.

Further, the tapered end face at the tip of the punch makes it easy to cause a flow of the material in the radial direction. Further, the periphery of the blank ends are enclosed by receiving die means, so that plastic flow of the material in the axial direction is restricted and the material filling rate of the gear is raised. Therefore, since the plastic flow of the material in the axial direction is restricted and the plastic flow in the radial direction is made easy, the gear can be formed without causing a large stress in the tooth portion of the gear die.

DESCRIPTION OF EMBODIMENTS

An embodiment of the present invention will be described hereunder, with reference to FIGS. 1–6.

Figure 1:
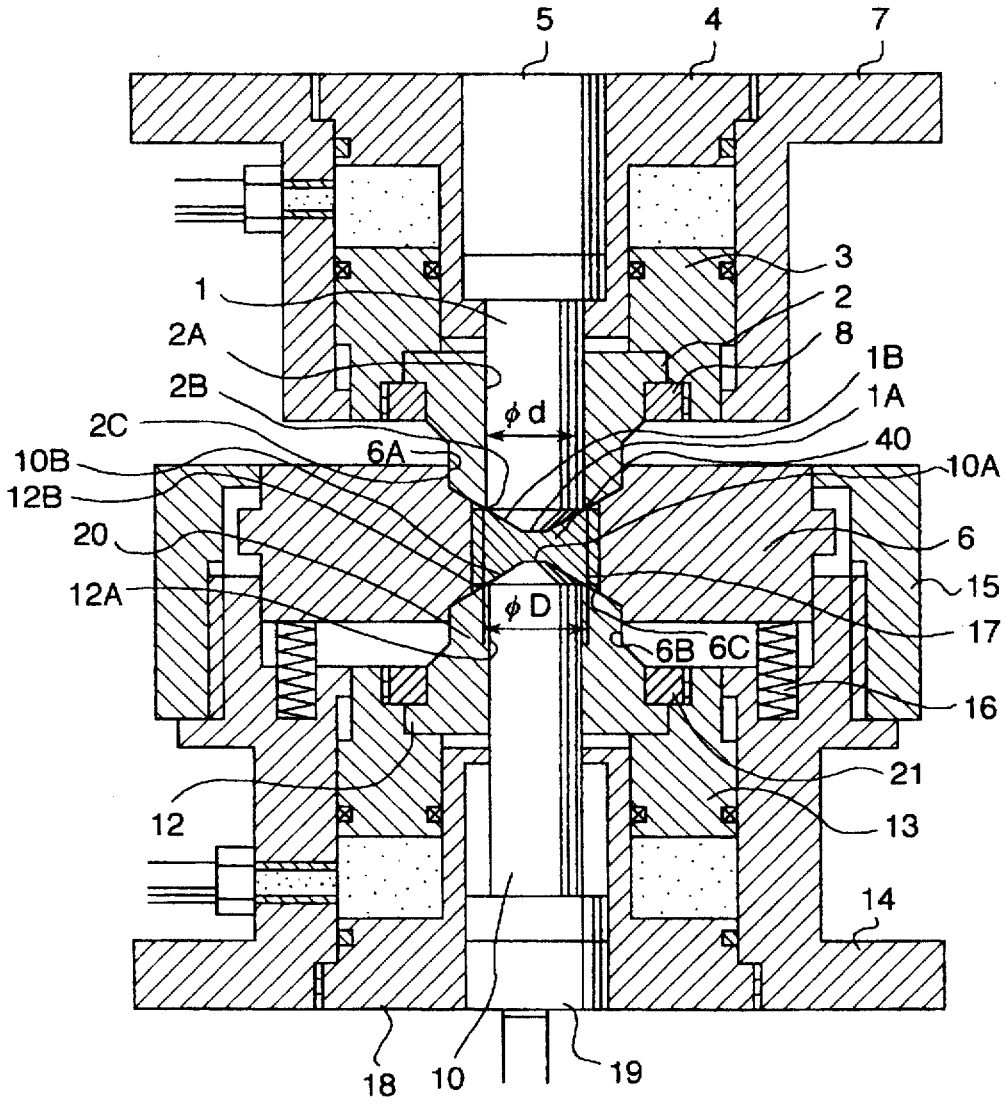
FIG. 1 is a vertical sectional view of a die construction in a state in which helical gear forming is completed, according to an embodiment of the present invention.
Figure 2:
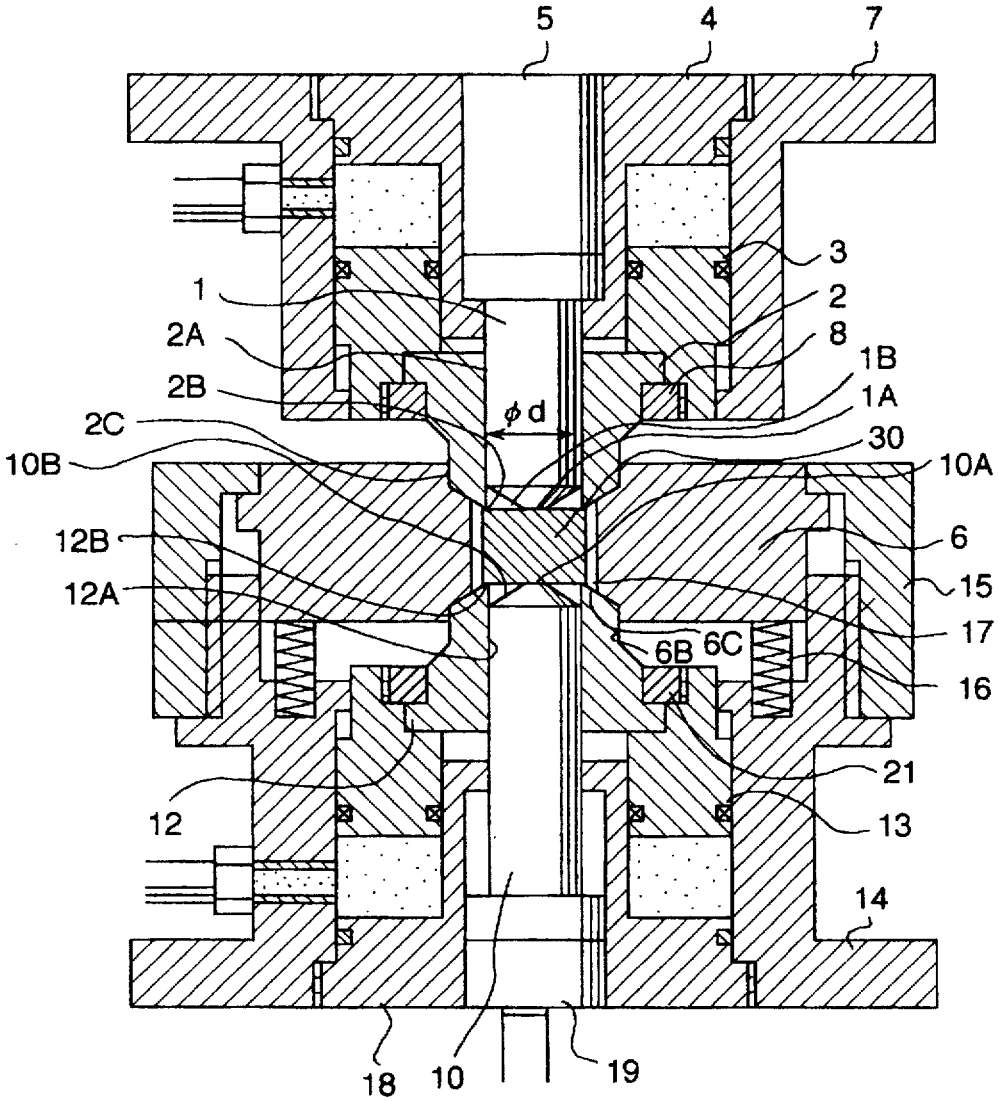
FIG. 2 is a vertical sectional view of the die construction in a state immediately before starting the helical gear forming, according to the embodiment of the present invention.

FIG. 1 shows an example of a die construction which is used for a plastic working method in the formation of a helical gear according to an embodiment of this invention, showing the state at a time when metal flow has been completed. FIG. 2 shows a state immediately before the start of metal flow.

An upper die assembly is constructed of a columnar punch 1, a constraint sleeve 2 slidably holding the punch 1, an upper sub-hydraulic cylinder device 3 and a punch holder 4. The punch 1 is preferably in a truncated cone shape and has a flat end face 1A and a tapered face 1B at a periphery thereof. The punch 1 is slidably inserted in a slide bore 2A of the constraint sleeve 2, is guided thereby, and is held by the punch holder 4 together with a punch backing member 5.

The diameter $\phi d$ of the punch 1 is set to be smaller than the small diameter $\phi D$ (corresponding to the root circle of the gear) of a gear die 6. The punch holder 4 is mounted to a T-letter shaped tubular holder 7 secured to a press ram not shown. Further, the constraint sleeve 2 has a constraint end face 2B and a guide portion 2C, and the sleeve 2 is held, using a screw-ring 8, by the upper sub-hydraulic cylinder device 3 mounted in the holder 7 and the punch holder 4.

A lower die assembly comprises the above-mentioned gear die 6, a columnar punch 10 arranged in opposite relation to the above-mentioned punch 1, a constraint sleeve 12 and a lower sub-hydraulic cylinder device 13. The gear die 6 is held, in a floating state, in tubular holders 14 and 15 fixed to a press bolster side by a spring 16 and the constraint sleeve 12 operating in synchronism with the lower sub-hydraulic cylinder device 13.

The gear die 6 has internal teeth 17 formed in the inner diameter portion for the helical gear and guide bores 6A and 6B formed at upper and lower opening ends, respectively. In practice, the gear die 6 has a multi-segment die construction in which a plurality of parts are combined and fitted into each other to form one die. The punch 10 is shaped in the form of a truncated cone at a tip thereof and has a flat end face 10A and a tapered face 10B at a periphery thereof, similar to the punch 1. The punch 10 also has the same shape and scale as the punch 1, and the punch 10 is slidably inserted in a slide bore 12A of the constraint sleeve 12, is guided thereby, and is held slidably by a punch holder 18 together with a punch backing member 19. The punch holder 18 is fixed to the tubular holder 14. Further, the constraint sleeve 12 also has a constraint end face 12B and a guide portion 20, and the sleeve 12 is held, using a screw-ring 21, by the lower sub-hydraulic cylinder device 13 mounted in the holder 14 and the punch holder 18.

In a gear forming process using the above die construction, first, with the upper die assembly being raised by the press ram not shown, the upper sub-hydraulic cylinder device 3 is operated as shown in FIG. 2. In the lower die assembly, the lower sub-hydraulic cylinder device 13 is operated so that the guide portion 20 of the constraint sleeve 12 is inserted in the guide bore 6B of the gear die 6, the constraint end face 12B abuts on the internal tooth end face 6C and the gear die 6 floats until the gear die 6 impinges on the holder 15.

Here, the holder 15 holds the gear die 6 so that the internal tooth end face 6C of the gear die 6 and the flat face 10A of the punch 10 are positioned on the same plane. Next, a blank 30 is inserted so as to be disposed on the punch 10, and then the press ram not shown is lowered, whereby the guide portion 2C of the constraint sleeve 2 is inserted in the guide bore 6A of the gear die 6, the constraint end face 2B abuts on the internal tooth end face 6C of the gear die 6, and the gear die 6 is held in a floating state under the condition that the blank 30 is constrained to move in the axial direction. This in the condition which exists immediately before the start of plastic flow.

In this condition, the constraint sleeves 2 and 12 are in abutting contact with the gear die 6 and the blank 30 is enclosed thereby. And then, when the press ram is lowered further, the punch 1 goes down while pressing the blank 30, and at the same time, the gear die 6 also is lowered so that the punch 10 goes into the blank 30. Therefore, by moving the two punches into the blank 30 from opposite sides, the material of the blank is compressed at the central portions and, at the same time, deformation stress along the tapered faces 1B and 10B in the radial direction is produced to cause the material to plastically flow in the direction of the internal teeth 17 of the gear die 6 for gear formation.

The above-mentioned plastic flow fills the space with the material along the tapered end faces of the constraint sleeves 2, 12, so that a tooth portion is formed while slowly balancing the material flow. Further, during the gear formation, the blank material around peripheral portions of the axial ends of the blank 30 is restricted from plastically flowing in the axial direction by the constraint end faces 2B, 12B of the constraint sleeves 2, 12 which are pressed by equal upper and lower forces produced by the upper and lower sub-hydraulic cylinder devices 3 and 13.

Figure 3:
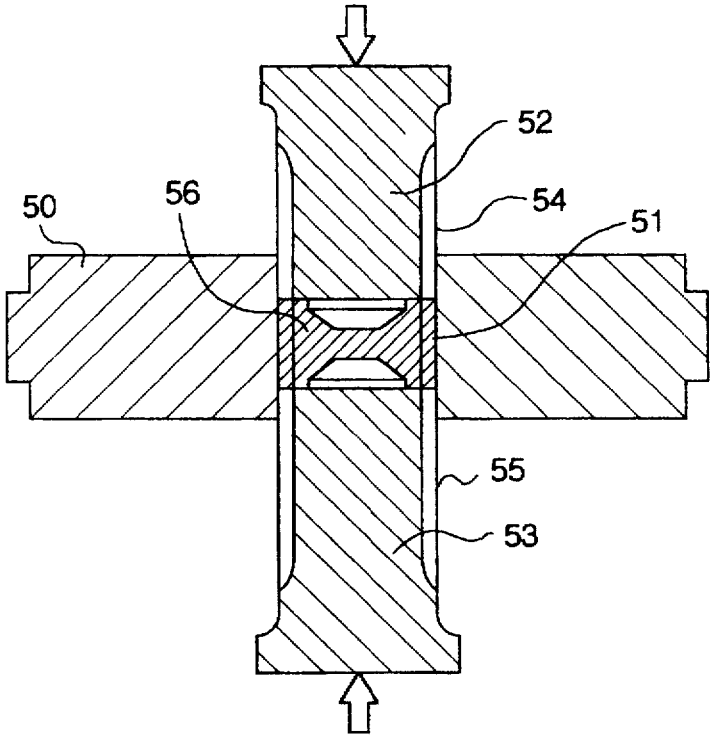
FIG. 3 is a vertical sectional view of a part of a die construction in a state in which a helical gear forming in the second step is completed.

A gear formed member 40 (that is, a gear formed blank, helical pinion A or intermediate blank) obtained in this manner functions sufficiently in gear apparatus used in a relatively rough manner, however, when further precision is required, finish working as shown in FIG. 3 is effected. That is, the above-mentioned gear member is constrained at its peripheral portion by a helical die 50 having internal teeth 51 for helical sizing and is held floatingly, and the gear member is pressed to be formed into a precise gear by helical punches 52 and 53 meshing slidably in the axial direction with the helical sizing internal teeth 51, whereby a high precision product is formed finely at its upper and lower end faces and tooth portion(press-sizing working using a press).

In the above-mentioned embodiment, the pair of punches each have a tip shaped in the form of a truncated cone, however, the tips of the punches each can be in a cone shape as long as the punch tips are constructed so that gear formation is possible without the tips impinging on each other.

According to the present embodiment, plastic flow in the axial direction is restricted by enclosing both end faces 41, 42 of the gear formed blank 40 with the constraint sleeves 2, 12, and the punches 1, 10, each of which has the tip which is smaller in diameter than the small diameter of the gear die 6 and is made conical, press the blank concentrically to form a gear, so that it is possible to effect plastic flow of the material of the blank in the radial direction in a well-balanced state. In particular, since almost no axial stress is applied to the internal tooth portion 17 for helical gear formation, the life of the gear die 6 is extended remarkably and a helical gear having a relatively high material filling rate can be formed, whereby an improvement in the manufacturing process and a reduction of the manufacturing cost can be achieved.

Figure 4:
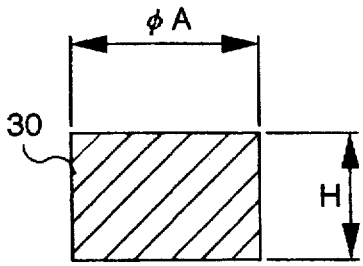
FIG. 4 is a vertical sectional view of a blank for a helical gear according to an embodiment of the present invention.
Figure 5:
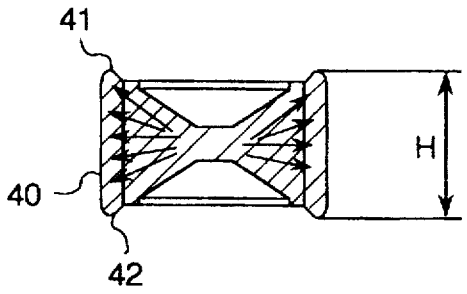
FIG. 5 is a vertical sectional view of a helical gear according to an embodiment of the present invention.
Figure 6:
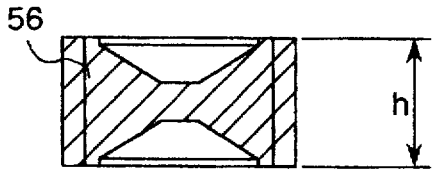
FIG. 6 is a vertical sectional view of a helical gear after completion of the second step according to an embodiment of the present invention.

Further, according to the present invention, sizing forming is effected for the portions 41, 42 left on the helical pinion (A) 40 obtained in the first step of the forming process, whereby the material filling rate of the gear can be raised remarkably. Each of the aspects of the blank and the helical pinion in the gear forming process are shown in FIGS. 4–6, wherein the height H of the blank 30 and the helical pinion (A) 40 are the same and the height h of the helical pinion (B) 56 becomes shorter by about 5% than the height H. However, since the portion which plastically flows in the axial direction is not hardened, the die life is not affected thereby.

Another embodiment of the present invention will be described hereunder, with reference to FIGS. 7–9.

Figures 7A, 7B:
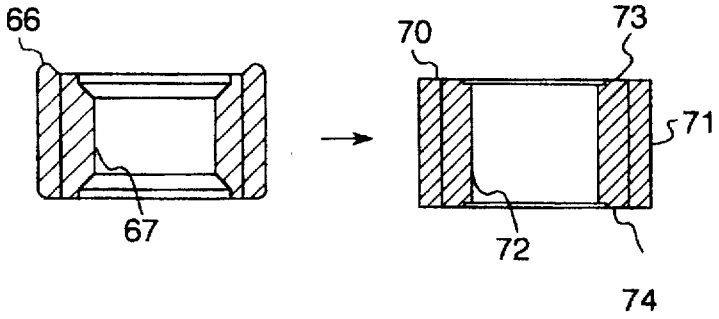
FIGS. 7*a* and 7*b* each are a vertical sectional view of a helical gear showing a forming process according to another embodiment of the present invention.

The present embodiment concerns a pinion gear having a shaft insertion hole or a mounting hole formed in the center thereof. The pinion gear is obtained by adding steps as shown in FIGS. 7*a*, 7*b* to the intermediate blank 40 as shown in FIG. 5.

Figure 8:
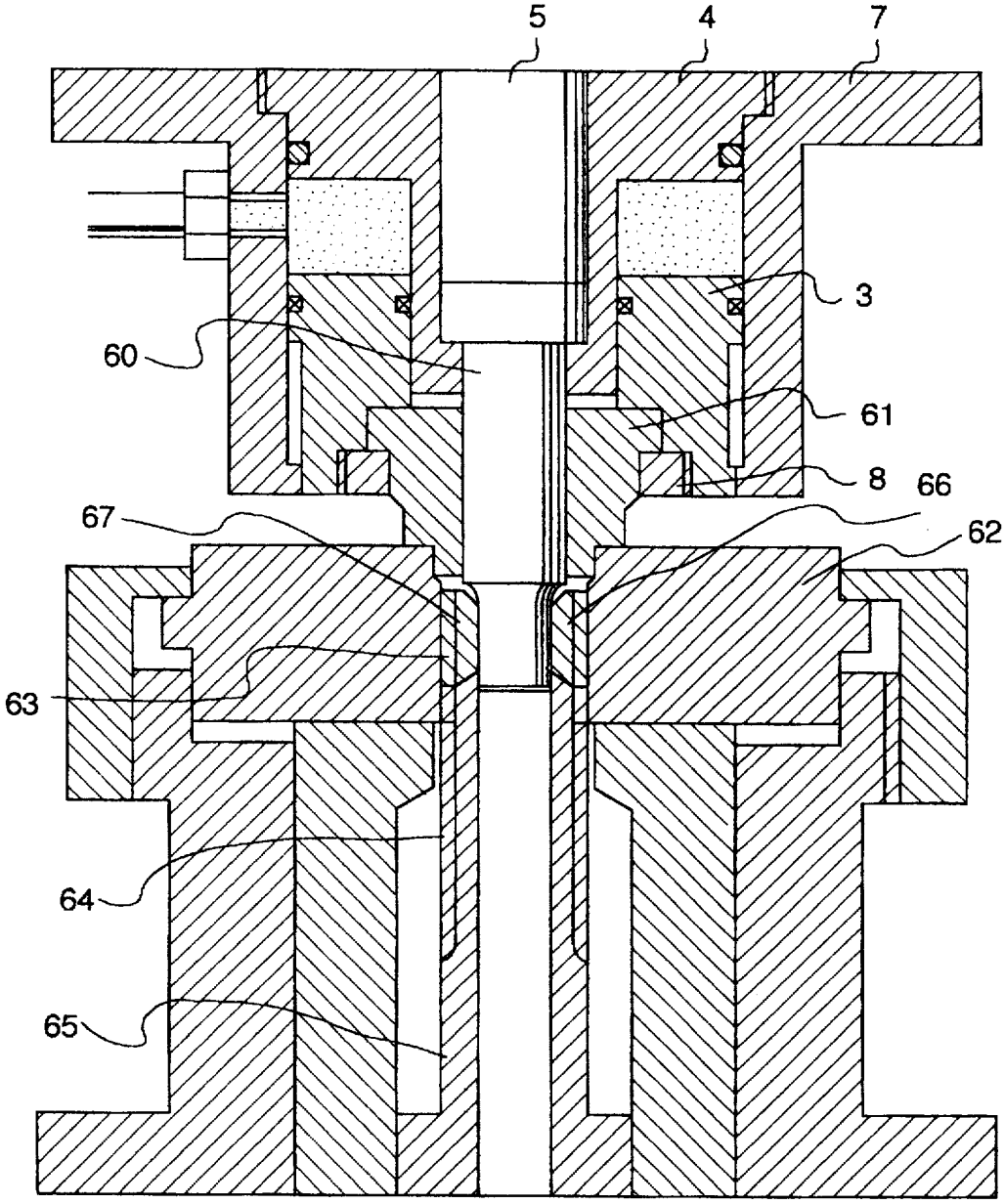
FIG. 8 is a vertical sectional view of a die construction in the forming state of the second step shown in FIGS. 7*a* and 7*b*.
Figure 9:
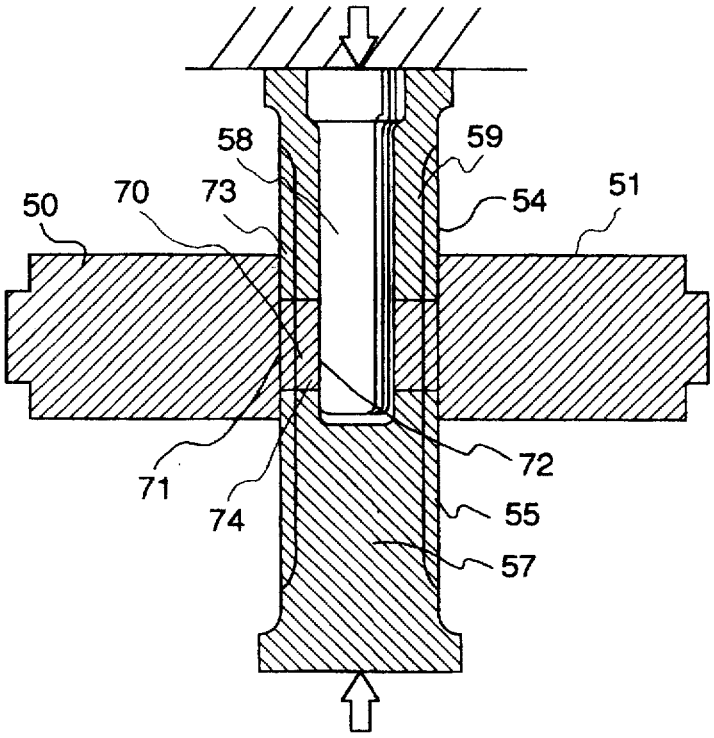
FIG. 9 is a vertical sectional view of an essential part of the die construction in the forming state of the third step shown in FIGS. 7*a* and 7*b*.

That is, the intermediate blank 40 obtained in the first step, as shown in FIG. 5, is punched by a die set shown in FIG. 8 to form a hollow blank 67. Next, sizing formation is applied to a helical gear 71, a hole 72, end faces 73, 74, etc. by a die set as shown in FIG. 9, whereby a helical spline 70 of high precision can be obtained.

The above-mentioned punching step will be further explained with reference to FIG. 8.

As a press ram not shown is lowered, a cushion sleeve 61, which is pressurized in advance by hydraulic pressure, or air pressure is inserted in a gear die 62 to maintain a concentric position between the cushion sleeve 61 and the gear die 62; a male punch 60 is lowered while being guided by the cushion sleeve 61 under the condition of the concentric position of the cushion sleeve 61 and the gear die 62; the punch 60 punches the intermediate blank 40 by action with a die 65, which has a helical gear portion 64 concentrically meshing with internal teeth 63 of the helical gear of the gear die 62, with a punched out scrap being discharged from the inner diameter of the die 65, whereby the punching step to form the follow blank 67 is completed.

In this manner, effecting the punching step within the gear die 62 constrains the periphery of the helical spline and prevents the periphery from being deformed by the punching force.

The sizing step will be explained, with reference to FIG. 9. The hollow blank 67 obtained by punching is inserted in a gear die 50; opposite punches 59, 57, which are shaped in the form of a gear at their periphery and one of which is provided with a mandrel 58, press the hollow blank 67 from the opposite directions, whereby the sizing step is completed.

In a series of the steps, the size of the internal teeth of the helical gear die is set to become larger in the following order: the first step, the punching step and the sizing step. The pinion products produced through the production steps each are a pinion having a hole of highly precise concentricity, and, as a result, gears of high precision can be obtained.

As mentioned above, according to the present invention, the formation of gears of high precision having a high material filling rate is possible and, in particular, the die life can be extended largely, so that an improvement in production process and a reduction in the production cost can be effected.

What is claimed is:

1. A method of forming a gear through cold plastic working, comprising the steps of:

disposing a disc-like blank in a gear die having a gear-shaped inner periphery so that an outer side periphery of the blank is surrounded by the gear-shaped inner periphery of the gear die;

holding peripheral portions of both upper and lower end faces of a blank using a pair of constraint members to constrain axial plastic flow of the material of the blank in the peripheral portions of the upper and lower end faces of the blank; and pressing concentrically on the upper and lower end faces of the blank with a pair of punches arranged and moved in opposite relation while restraining axial plastic flow in the peripheral portion of the blank and allowing radial plastic flow of the material into the gear die, thereby to form a gear, each of the punches having a diameter equal to or less than a small diameter of the gear die and having a tapered portion at a tip thereof.

2. A method of forming a gear according to claim 1, wherein each of the pair of punches is shaped as a truncated cone.

3. A method of forming a gear according to claim 1 or 2 wherein the constraint members each have a conical tapered face at the tip.

4. A method of forming a gear according to claim 1 wherein the gear is a helical gear.

5. A method of forming a gear according to claim 1 wherein the gear formed in said pressing step is inserted in a further gear die and pressed from upper and lower sides by gear shaped punches, thereby to form a high precision gear.

6. A method of forming a gear according to claim 1 wherein the gear formed in said pressing step is inserted in a further gear die and punched, while in the same step, the blank is pressed by gear-shaped punches to form a high precision gear.

7. A method of forming a gear according to claim 1, wherein the punches of the pair of punches have substantially the shape at the tip end portion as each other and press the blank from the upper and lower end faces of the blank.

8. A method of forming a gear according to claim 7, wherein each of the pair of punches presses the blank so that plastic flow occurs only in the radial direction and in a punch advance movement direction.

9. A method of forming a gear through cold plastic working, comprising the steps of:

disposing a blank in a gear die;

holding peripheral portions of both upper and lower end faces of a blank using a pair of constraint members to constrain axial plastic flow of the material of the blank in the peripheral portions of the upper and lower end faces of the blank;

pressing concentrically on the upper and lower end faces of the blank with a pair of punches arranged in opposite relation while restraining axial plastic flow in the peripheral portions of the upper and lower end faces of the blank, each of the punches having a diameter equal to or less than a small diameter of the gear die arranged around a periphery thereof and a tapered portion at a tip thereof to cause radial plastic flow of the material into the gear die, thereby to form an intermediate gear;

punching the intermediate gear; and then inserting the punched intermediate gear in a gear die to effect sizing formation by gear-shaped punches or a mandrel.

* * * * *